US007261335B2

(12) United States Patent
Schupp

(10) Patent No.: US 7,261,335 B2
(45) Date of Patent: Aug. 28, 2007

(54) POWER RELEASE SIDE DOOR LATCH WITH EMERGENCY RELEASE SYSTEM

(75) Inventor: Michael W. Schupp, Farmington Hills, MI (US)

(73) Assignee: Intier Automotive Closures Inc., Newmarket, Ontario (CA)

( * ) Notice: Subject to any disclaimer, the term of this patent is extended or adjusted under 35 U.S.C. 154(b) by 251 days.

(21) Appl. No.: 10/987,912

(22) Filed: Nov. 12, 2004

(65) Prior Publication Data

US 2005/0104382 A1 May 19, 2005

(51) Int. Cl.
*E05C 3/06* (2006.01)

(52) U.S. Cl. ..... 292/201; 292/216; 292/DIG. 65; 292/DIG. 23

(58) Field of Classification Search ..... 292/201, 292/216, DIG. 65 X, DIG. 23
See application file for complete search history.

(56) References Cited

U.S. PATENT DOCUMENTS

| | | | | |
|---|---|---|---|---|
| 4,135,377 | A | 1/1979 | Kleefeldt et al. | |
| 4,763,936 | A * | 8/1988 | Rogakos et al. | 292/201 |
| 4,978,154 | A * | 12/1990 | Kleefeldt et al. | 292/201 |
| 5,078,436 | A * | 1/1992 | Kleefeldt et al. | 292/201 |
| 5,901,991 | A | 5/1999 | Hugel et al. | |
| 5,992,194 | A | 11/1999 | Baukholt et al. | |
| 6,003,910 | A * | 12/1999 | Dupont et al. | 292/201 |
| 6,050,117 | A | 4/2000 | Weyerstall | |
| 6,053,543 | A * | 4/2000 | Arabia et al. | 292/201 |
| 6,056,334 | A | 5/2000 | Petzold et al. | |
| 6,062,613 | A * | 5/2000 | Jung et al. | 292/201 |
| 6,112,564 | A | 9/2000 | Rathmann et al. | |
| 6,116,664 | A | 9/2000 | Wegner | |
| 6,290,269 | B1 | 9/2001 | Bodley-Scott et al. | |
| 6,349,983 | B1 | 2/2002 | Dupont et al. | |
| 6,471,259 | B1 | 10/2002 | Weyerstall et al. | |
| 6,719,333 | B2 * | 4/2004 | Rice et al. | 292/216 |
| 6,733,052 | B2 * | 5/2004 | Perkins et al. | 292/201 |
| 6,848,286 | B2 * | 2/2005 | Dimig | 70/277 |
| 7,048,314 | B2 * | 5/2006 | Spurr | 292/216 |
| 2002/0167176 | A1 | 11/2002 | Erices et al. | |
| 2002/0167177 | A1 | 11/2002 | Erices et al. | |
| 2003/0155779 | A1 | 8/2003 | Belmond et al. | |
| 2003/0164616 | A1 * | 9/2003 | Belmond et al. | 292/201 |
| 2003/0178859 | A1 | 9/2003 | Belmond et al. | |

* cited by examiner

*Primary Examiner*—Brian E. Glessner
*Assistant Examiner*—Mark Williams
(74) *Attorney, Agent, or Firm*—Clark Hill PLC

(57) ABSTRACT

A latching assembly for a side door of a motor vehicle is disclosed. The motor vehicle includes an electrical system and an electric power source. The side door includes a pawl which is used in the unlatching of the side door. The latching assembly includes a housing that is fixedly secured to the side door for securing the latch assembly thereto. The latching assembly also includes a primary motor fixedly secured to the housing and electrically connected to the electrical power source through the electrical system to receive electricity from the electric power source. The primary motor converts the electricity into a rotational force. The latching assembly also includes a lever that is operatively connected to the primary motor to receive the rotational force and to translate the rotational force into a linear force to move the pawl to an unlatched position. The latching assembly includes a battery which is fixedly secured to the housing and a secondary motor which is fixedly to the housing and electrically connected to the battery. The secondary motor provides a secondary force to move the pawl to the unlatched position when the primary motor is disconnected from the electric power source.

12 Claims, 2 Drawing Sheets

POWER RELEASE SIDE DOOR LATCH WITH EMERGENCY RELEASE SYSTEM

BACKGROUND ART

1. Field of the Invention

The invention relates to a door latch. More specifically, the invention relates to an electrical door latch for a motor vehicle that does not have a manual backup.

2. Description of the Related Art

It is desirable to have electrically activated side door latches in motor vehicles. The problem with such electrically activated side door latches is they lack the ability to have the latch be activated to release and open the side door in a failure mode, such as when the motor vehicle is in an accident. In such situations, the power cable connecting the battery to the electrically activated side door latch may be severed preventing the latch from operating correctly.

To avoid this situation, the latch typically has a mechanical release which serves as a backup to the electrically activated side door latch. The redundant mechanical release that acts as a backup to the electrically activated side door latch adds weight and assembly costs and further limits the design of the door. Therefore, there is a need in the art to eliminate the mechanical release.

SUMMARY OF THE INVENTION

A latching assembly for a side door of a motor vehicle is disclosed. The motor vehicle includes an electrical system and an electric power source. The side door latch includes a pawl which is used in the unlatching of the side door. The latching assembly includes a housing that is fixedly secured to the side door for securing the latch assembly thereto. The latching assembly also includes a primary motor fixedly secured to the housing and electrically connected to the electrical power source through the electrical system to receive electricity from the electric power source. The primary motor converts the electricity into a rotational force. The latching assembly also includes a lever that is operatively connected to the primary motor to receive the rotational force and to translate the rotational force into a linear force to move the pawl to an unlatched position. The latching assembly includes a battery, which is fixedly secured to the housing, and a secondary motor, which is fixedly secured to the housing and electrically connected to the battery. The secondary motor provides a secondary force to move the pawl to the unlatched position when the primary motor is disconnected from the electric power source.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
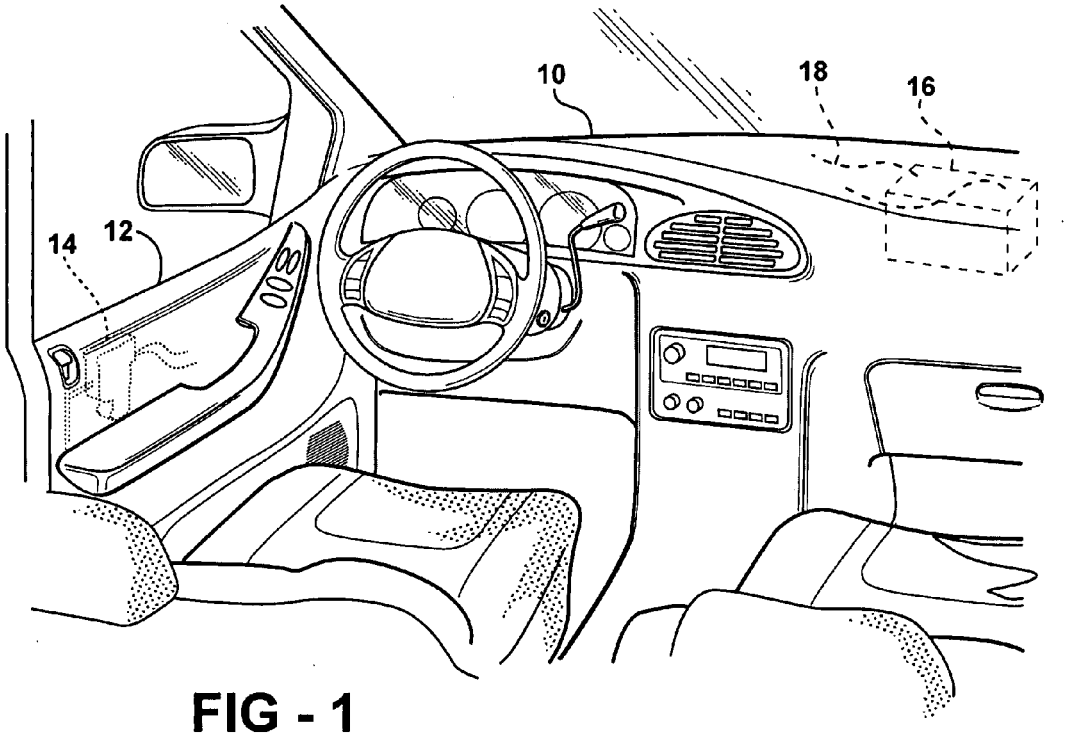
FIG. 1 is a fragmentary perspective view of a motor vehicle incorporating one embodiment of the invention.

Referring to FIG. 1, a motor vehicle 10 includes at least one side door 12. The side door 12 is movable between an open position and a close position. A latching assembly, generally indicated at 14, latches the side door 12 in the close position during normal operation of the motor vehicle 10.

The latching assembly 14 is an electrical latching assembly. The latching assembly 14 is electrically connected to an electric power source 16 via an electrical system 18. The electric power source 16 is shown as a car battery, but it should be appreciated by those skilled in the art that the electricity may come from a power source other than the battery, e.g., an alternator. These electric power generating devices are generically referred to as the electric power source 16 hereinafter.

Figure 2:
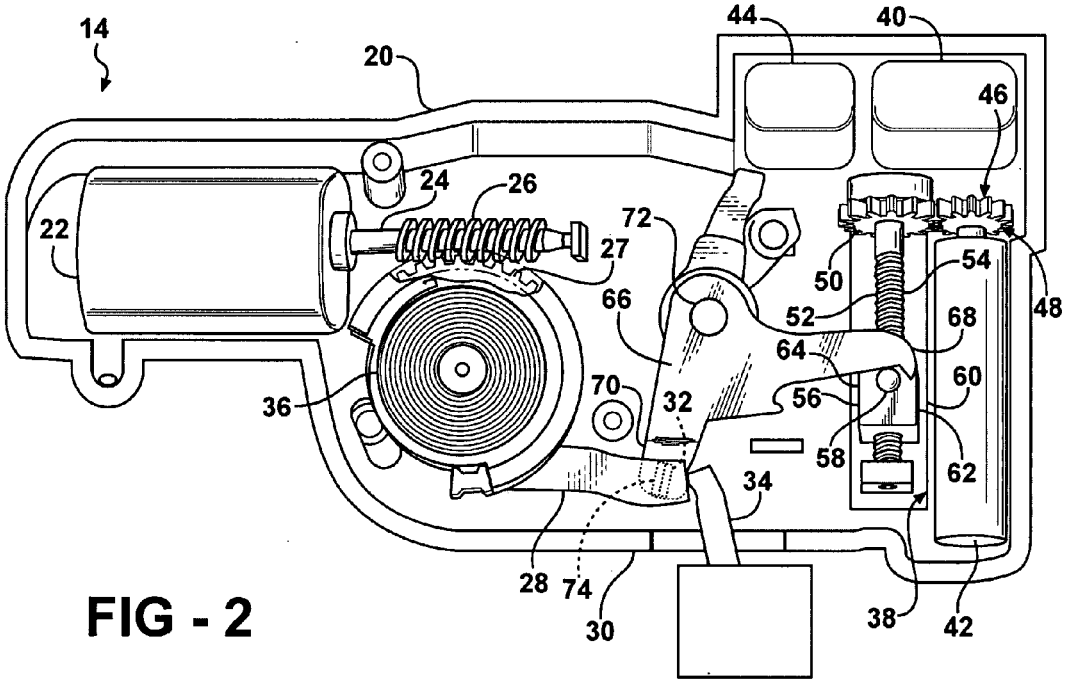
FIG. 2 is a plan view of the invention in a latch position.

Referring to FIG. 2, the latching assembly 14 is shown having a housing 20. The housing 20 protects the latching assembly 14 from the elements that may access the inside of the side door 12. The housing 20 also provides a structure against which the latching assembly 14 may be manufactured. It should be appreciated by those skilled in the art that only a portion of the housing 20 is shown in the Figures for purposes of clarity.

Figure 3:
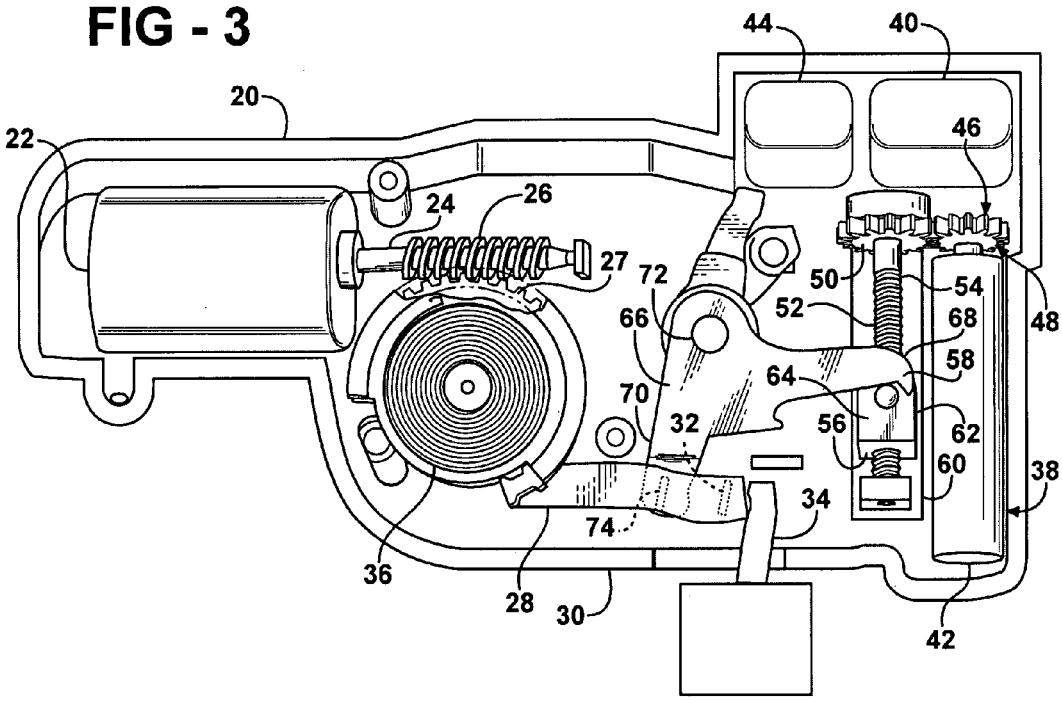
FIG. 3 is a plan view of the latch in a primary unlatch position.

The latching assembly 14 includes a primary motor 22. The primary motor 22 is fixedly secured to the housing 20. The primary motor 22 is electrically connected to the electric power source 16 via the electrical system 18. The primary motor 22 converts the power it receives from the electric power source 16 into a rotational force that drives an output shaft 24. The output shaft 24 has a worm gear 26 extending along a portion thereof. The worm gear 26 drives a sector gear 27, which forces a lever 28 to move laterally along an edge 30 of the housing 20 from a first position to a second position. The lever 28 is moved left to right in the Figures. The lever 28 has a distal flange 32 that extends perpendicular to the majority of the lever 28. The distal flange 32 abuts against a pawl 34. Movement of the pawl 34 releases a ratchet (not shown) that disengages with a striker. When the ratchet is engaged with the striker, the side door 12 is secured in a close position with respect to the motor vehicle 10. As may be seen in FIG. 3, the pawl 34 is moved from a left, latch position (FIG. 2) to its right unlatch position. The lever 28 is spring biased by a spring 36 to return to the first position when the primary motor 22 is reversed to reset the pawl 34 allowing the ratchet to secure the striker therein and latch the side door 12 to the motor vehicle 10 in the closed position.

The above describes how the latching assembly 14 operates under normal operating conditions. Should the latching assembly 14 fail to operate in a normal operating mode, a secondary drive, generally shown at 38, will engage the pawl 34 and operate the pawl to unlatch the latching assembly 14 allowing the side door 12 to move.

Referring specifically to the secondary drive 38, a battery 40 is fixedly secured to the housing 20. The battery 40 is designed to have a long life and is only to be used in situations where the primary motor 22 is not operating. The battery 40 provides a back up source of energy should the latching assembly 14 be completely severed from the electrical system 18. During normal operation, the battery 40 is recharged by the electrical power source 16 through the electrical system 18 as is needed to maintain the battery 40 in its fully charged state.

The secondary drive 38 includes a secondary motor 42. The secondary motor 42 is fixedly secured to the housing 20 and is electrically connected to the battery 40. The secondary motor 42 provides a secondary force to move the pawl 34 to the unlatch position when the primary motor 22 is disconnected from the electric power source 16. The secondary motor 42 is a small motor so that the size of the secondary motor 42 does not unduly increase the size of the latch assembly 14 given the expectedly minimal operation of the secondary motor 42. The secondary motor 42 will be activated by a controller 44 which is electrically connected to the battery 40 and the electrical system 18. The controller 44 receives an input from the electrical system 18 identifying when the primary motor 22 is severed from the electrical system 18 such that the primary motor 22 is no longer operable. When the controller 44 identifies such an event, it will engage the secondary motor 42 by closing a circuit between the battery 40 and the secondary motor 42 to operate the secondary motor 42.

A transmission 46 is operatively connected to the secondary motor 42. The transmission 46 includes a casing (not shown) and a plurality of gears 48, 50 that modify the output of the secondary motor 42 in rotational speed and direction.

A lead screw 52 is fixedly secured to one gear 50 of the transmission 46. The lead screw 52 includes a threaded portion 54. A follower 56 moves up and down the threaded portion 54 of the lead screw 52 when the lead screw 52 is rotated by the secondary motor 42. The follower 56 does not rotate, so the rotation of the lead screw 52 will allow the follower 56 to move axially up and down the lead screw 52. The follower 56 includes a follower knob 58 which extends out from the follower 56. The follower 56 travels in a channel 60 that has sides 62, 64 to prevent the follower 56 from rotating along with the lead screw 52.

The latching assembly 14 also includes a bellcrank 66 which extends between the follower 56 and the pawl 34. The bellcrank 66 defines a follower end 68 and a pawl end 70, wherein the follower end 68 abuts the follower knob 58 of the follower 56 and the pawl end 70 abuts against the pawl 34. The bellcrank 66 pivots about a pivot post 72 between an initial position and a rotated position. The bellcrank 66 translates the axial movement of the follower 56 into an axial movement of the pawl 34 which is oriented ninety degrees (90°) from the movement of the follower 56.

The pawl end 70 of the bellcrank 66 includes a flange 74 that extends perpendicular to the majority of the bellcrank 66. The flange 74 engages the distal flange 32 of the lever 28. Therefore, the lever 28 moves with the bellcrank 66 even though the primary motor 22 does not operate. By engaging the lever 28 with the bellcrank 66, the bellcrank 66 may use the spring 36 to return the bellcrank 66 and the lever 28 to a latch position when the secondary motor 42 retracts the follower 56.

Figure 4:
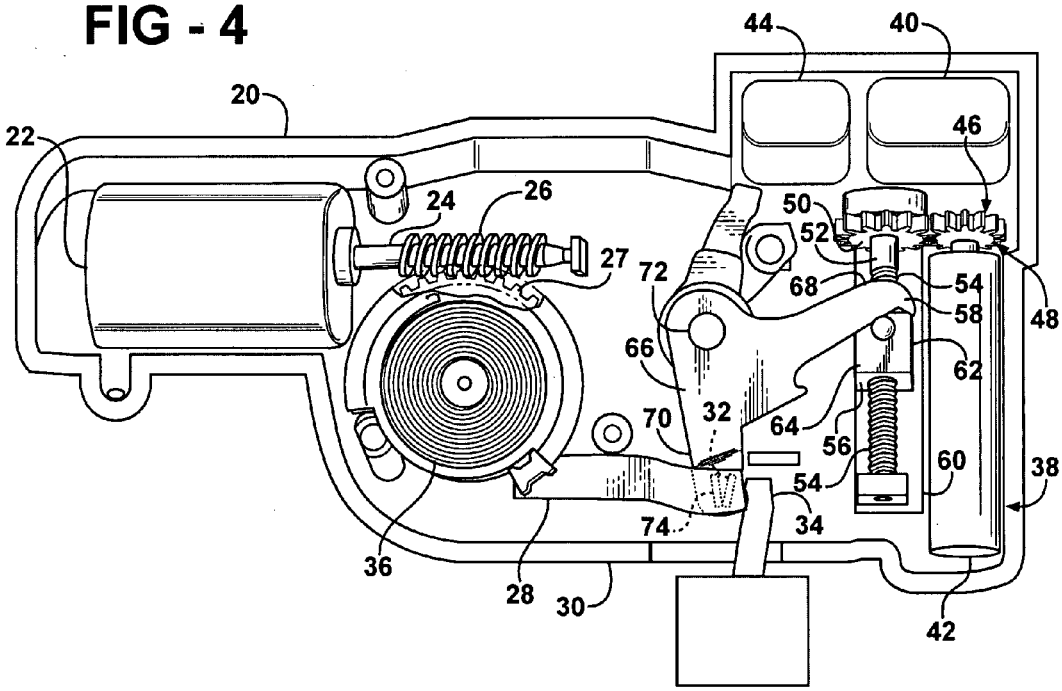
FIG. 4 is a plan view of the invention in the secondary unlatch position.

In operation, when the primary motor 22 is no longer operable, the controller 44 identifies the condition through an electrical connection with the electrical system 18. Upon the detection of the failure of the primary motor 22, the controller 44 engages the secondary motor 42 to rotate the transmission 46 which, in turn, rotates the lead screw 52. Rotation of the lead screw 52 moves the follower 56 from a lower position to an upper position (FIG. 4) which pivots the bellcrank 66 in a counterclockwise direction in the Figures from the initial position to the rotated position. The counterclockwise pivotal movement of the bellcrank 66 moves the pawl 34 to its unlatch position allowing the side door 12 of the motor vehicle 10 to open. The power for the secondary motor 42 is provided by the battery 40. When the secondary motor 42 is reversed, the spring 36 forces the lever 28 to the first position and the bellcrank 66 to retract along with the follower 56 to the initial position.

The above-described embodiments of the invention are intended to be examples of the present invention and alterations and modifications may be effected thereto, by those skilled in the art, without departing from the scope of the invention which is defined solely by the claims appended hereto.

What is claimed is:

1. A latching assembly for a side door of a motor vehicle having an electrical system, an electric power source and a pawl used to unlatch the side door, said latching assembly comprising:

a housing fixedly secured to the side door for securing said latch assembly thereto;

a primary motor fixedly secured to said housing and electrically connected to the electric power source through the electrical system to receive electricity from the electric power source and to convert the electricity into a rotational force;

a lever operatively connected to said primary motor to receive said rotational force and to translate said rotational force into linear movement of said lever from a first position to a second position thereby moving the pawl from a latch position to an unlatch position;

a spring for biasing said lever toward said first position allowing said pawl to reset to said latch position:

a battery fixedly secured to said housing;

a secondary motor fixedly secured to said housing and electrically connected to said battery, to receive electricity from the battery and to convert the electricity into a secondary force to move the pawl to the unlatch position when said primary motor is disconnected from the electric power source; and a bellcrank engaging said lever and operatively connected to said secondary motor to receive said secondary force and to translate said secondary force into pivotal movement of said bellcrank from an initial position to a rotated position thereby moving the pawl from said latch position to said unlatch position and said lever from said first position to said second position, whereat said spring biases said lever toward said first position and said bellcrank toward said initial position allowing said pawl to reset to said latch position after said secondary motor terminates said secondary force.

2. A latching assembly as set forth in claim 1 including a transmission operatively connected to said secondary motor for receiving said secondary force and for translating said secondary force.

3. A latching assembly as set forth in claim 2 including a lead screw connected to said transmission to be rotated thereby.

4. A latching assembly as set forth in claim 3 including a follower threadingly engaging said lead screw, said follower moving linearly along said lead screw in response to rotation thereby.

5. A latching assembly as set forth in claim 4 wherein said bellcrank extends between a follower end engaging said follower and a pawl end engaging the pawl and said lever, whereby linear movement of said follower in a first direction pivots said bellcrank from said initial position to said rotated position thereby moving the pawl to said unlatch position.

6. A latching assembly as set forth in claim 5 including a controller for operating said secondary motor.

7. A latching assembly as set forth in claim 6 wherein said lever includes a distal flange abutting a flange at said pawl end of said bellcrank such that pivotal movement of said bellcrank causes said flange to engage said distal flange and moves said lever therewith.

8. A latching assembly as set forth in claim 7 wherein said controller includes an electrical connection to the electrical system to identify when said primary motor is disabled.

9. A latching assembly for a side door of a motor vehicle having an electrical system, an electric power source and a pawl used to unlatch the side door, said latching assembly comprising:

a housing fixedly secured to the side door for securing said latch assembly thereto;

a primary motor fixedly secured to said housing and electrically connected to the electric power source through the electrical system to receive electricity from the electric power source and to convert the electricity into a rotational force;

a lever operatively connected to said primary motor to receive said rotational force and to translate said rotational force into linear movement of said lever from a first position to a second position thereby moving the pawl from a latch position to an unlatch position;

a spring for biasing said lever toward said first position allowing said pawl to reset to said latch position;

a battery fixedly secured to said housing;

a secondary motor fixedly secured to said housing and electrically connected to said battery to receive electricity from the battery and to convert the electricity into a secondary force to move the pawl to the unlatch position when said primary motor is disconnected from the electric power source;

a transmission operatively connected to said secondary motor to receive said secondary force and modify said secondary force to rotate a lead screw;

a follower threadingly engaging said lead screw and moving linearly along said lead screw in response to rotation of said lead screw; and a bellcrank extending between a follower end engaging said follower and a pawl end engaging the pawl and said lever, whereby linear movement of said follower in a first direction pivots said bellcrank from an initial position to a rotated position thereby moving the pawl from said latch position to said unlatch position and said lever from said first position to said second position, whereat said spring biases said lever toward said first position and said bellcrank toward said initial position allowing said pawl to reset to said latch position after said secondary motor terminates said secondary force.

10. A latching assembly as set forth in claim 9 including a controller for operating said secondary motor.

11. A latching assembly as set forth in claim 10 wherein said lever includes a distal flange abutting a flange at said pawl end of said bellcrank such that pivotal movement of said bellcrank causes said flange to engage said distal flange and moves said lever therewith.

12. A latching assembly as set forth in claim 11 wherein said controller includes an electrical connection to the electrical system to identify when the primary motor is disabled.

* * * * *